US006461149B1

(12) United States Patent
Ahmady

(10) Patent No.: US 6,461,149 B1
(45) Date of Patent: Oct. 8, 2002

(54) GAS BURNER WITH CONTROLLED THERMAL EXPANSION

(75) Inventor: Farshid Ahmady, Sterling Heights, MI (US)

(73) Assignee: Soloranics, Inc.

( * ) Notice: Subject to any disclaimer, the term of this patent is extended or adjusted under 35 U.S.C. 154(b) by 0 days.

(21) Appl. No.: 09/510,036

(22) Filed: Feb. 22, 2000

(51) Int. Cl.[7] ..... F23D 14/14
(52) U.S. Cl. ..... 431/329; 431/354; 431/326
(58) Field of Search ..... 431/354, 326, 431/328, 329, 100, 110; 126/92 R, 92 AC

(56) References Cited

U.S. PATENT DOCUMENTS

| | | | | | |
|---|---|---|---|---|---|
| 624,494 | A | * | 5/1899 | Homan | 431/355 |
| 922,502 | A | * | 5/1909 | Park | 431/328 |
| 3,029,866 | A | * | 4/1962 | Honger | 431/329 |
| 3,129,749 | A | * | 4/1964 | Honger | 431/329 |
| 3,199,570 | A | * | 8/1965 | Williams et al. | 431/329 |
| 3,202,204 | A | * | 8/1965 | Jouard | |
| 3,225,815 | A | * | 12/1965 | Bauer et al. | |
| 3,298,419 | A | * | 1/1967 | Nicholson | 431/329 |
| 3,303,869 | A | * | 2/1967 | Hayama | 431/329 |
| 3,360,028 | A | * | 12/1967 | Saponara et al. | 126/92 R |
| 3,847,536 | A | * | 11/1974 | Lepage | 431/329 |
| 3,857,670 | A | * | 12/1974 | Karlovertz et al. | 43/329 |

FOREIGN PATENT DOCUMENTS

| | | | | |
|---|---|---|---|---|
| GB | 1311022 | * | 3/1973 | 431/328 |
| GB | 1433771 | * | 4/1976 | 431/328 |
| JP | 10-339410 | * | 12/1998 | 431/328 |

* cited by examiner

*Primary Examiner*—Carl D. Price
(74) *Attorney, Agent, or Firm*—Young & Basile

(57) ABSTRACT

A gas-fired infra-red burner has a dome-shaped wire mesh burner screen bulging out of the plane of the burner opening away from a plenum. This bulge or dome effect allows the screen to undergo controlled thermal expansion without any rippling, waviness or other undesirable deformation of the screen. A metal blocking plate is secured to the center of the screen and blocks the flow of gas therethrough to create a non-radiating zone at the center of the burner, thus providing even heating over the surface of the food being cooked. A plurality of creases radiate from the approximate center of the plate in a star-shaped pattern, and the plate is bent about several of the creases to give it a concave surface which contacts the screen. When heated, the creases grow in height so that the overall horizontal dimensions of the plate do not increase as much as would a flat plate. The burner venturi tube is of circular cross section adjacent its upstream end and transitions to a flattened, elliptical cross section adjacent the end where it connects to the plenum. The major axis of the elliptical cross section is parallel to the burner opening so that the depth of the plenum, and hence the overall depth of the entire burner unit, may be smaller than if the circular cross section were connected directly to the plenum.

11 Claims, 3 Drawing Sheets

GAS BURNER WITH CONTROLLED THERMAL EXPANSION

FIELD OF THE INVENTION

This invention relates to gas-fired infra-red burners such as those used in ovens and broilers.

BACKGROUND OF THE INVENTION

Gas-fired infra-red burners are widely used in both commercial and domestic cooking ranges. Such gas ranges typically have a broiler unit mounted at the top surface of an oven and oriented downwardly to provide a top-broil feature. A burner unit generally comprises a plenum chamber supplied with a combustible gas/air mixture through a venturi and a burner element made from either perforated ceramic tile or a wire mesh through which the gas/air mixture escapes. The gas/air mixture is ignited to produce a flame adjacent the outer surface of the tile or mesh.

A metal mesh screen is often preferred to a ceramic burner for durability reasons. A metal screen, however, undergoes significant thermal expansion and contraction during use as it cycles between room temperature and approximately 1500° F. When a flat piece of screen is secured to the burner plenum around its edges, this thermal expansion can cause warping, rippling, and other undesirable deformation of the screen. Some prior art burners feature a screen formed with a series of ridges or undulations prior to being secured to the plenum, the ridges absorbing the dimensional changes from expansion and contraction by varying somewhat in height and/or horizontal spacing.

In general, a large burner area is preferable in order to provide relatively even heating over the surface of an object or objects being cooked, hereinafter known as the load. A burner, however, always heats the portion of the load adjacent the center of the burner more than the portion away from its center. This is because every point on the burner radiates heat to all points on the load along a line-of-sight, with the intensity of the heat transferred to the load being inversely proportional to the distance between the burner and the load. Consequently, the load adjacent the center of the burner receives intense infra-red rays traveling the relatively short distance from the center of the burner, plus relatively weaker rays traveling the greater distance from the edges of the burner.

The portions of the load adjacent the edges of the burner, however, receive only a fraction of the total heat received by the central portion, since these edge portions are not completely surrounded by the burner.

It is known to create a burner having a more even heat distribution by providing a non-radiating zone at the center of the burner. This has been achieved in ceramic tile burners by placing a metal blocking plate on the rear surface of the tile and sealing the periphery to the plate to the tile with a gasket. This blocks the flow of gas through the holes in the center of the tile so that no flame is present in the central area of the burner.

In the past it has been impractical to construct a wire mesh burner in which the gas flow is blocked in an area at the center of the burner to create a non-radiating zone. The primary problem is due to the difficulty in securing a metal plate to a wire mesh in a manner that will survive when the burner expands and contracts due to heating and cooling during use. A wire mesh screen and a solid metal plate undergo thermal expansion of different magnitude, at different rates, and in different directions. This expansion differential makes it extremely difficult to secure the plate to the mesh in a manner that will remain intact and not result in rippling and/or other undesirable deformations of the wire mesh and attached blocking plate during the many cycles of thermal expansion and contraction that occur during normal use. This problem is particularly pronounced when the area of the burner is large.

SUMMARY OF THE INVENTION

According to the present invention, a gas-fired infra-red burner comprises a plenum for receiving a gas/air mixture and having a generally planar burner opening, and a wire mesh screen secured to the plenum around the perimeter thereof and bulging out of the plane of the burner opening away from the plenum. This bulge or dome effect allows the screen to undergo thermal expansion when the burner is operating without any rippling, waviness or other undesirable deformation of the screen. Rather, expansion of the screen causes the dome to increase slightly in height in a uniform, controlled manner.

According to a further feature of the invention, a metal plate is secured to the approximate center of the screen to block the flow of gas therethrough, thus creating a non-radiating zone at the center of the burner. Such a burner provides a more even heat so that portions of the load adjacent the center of the burner do not receive substantially more infra-red heating than those portions closer to the edges of the burner.

In the preferred embodiment of the invention, the blocking plate is formed with a plurality of creases radiating from the approximate center of the plate in a star-shaped pattern, and is bent about at least one of the creases so that the plate has a concave surface which contacts the screen. The plate is spot welded to the screen at a plurality of points adjacent the edges of the plate. As the plate expands when heated, the creases grow in height so that the overall horizontal dimensions of the plate do not increase as much as would a flat plate. Accordingly, the creases allow the plate to expand in a controlled manner so that the plate and the wire screen do not shift or separate relative to one another during temperature changes.

According to another feature of the invention, the venturi tube which feeds the gas/air mixture to the burner has a circular cross section adjacent its upstream end and transitions to a flattened, elliptical cross section adjacent the end where it connects to the plenum. The major axis of the elliptical cross section is parallel to the burner opening so that the depth of the plenum, and hence the overall depth of the entire burner unit, may be smaller than if the circular cross section were connected directly to the plenum. The internal area of the elliptical section be at least equal to the internal area of the circular section at its largest diameter to avoid a constriction that would interfere with proper flow of the gas/air mixture into the plenum.

According to yet another feature of the present invention, the dome shape of the screen is achieved by bending portions of the screen adjacent parallel, opposite edges of the screen in the direction of the desired bulge to form tabs which are then secured to corresponding parallel, opposite edges of the plenum. This causes the central portion of the screen to bulge outwardly from the plenum.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
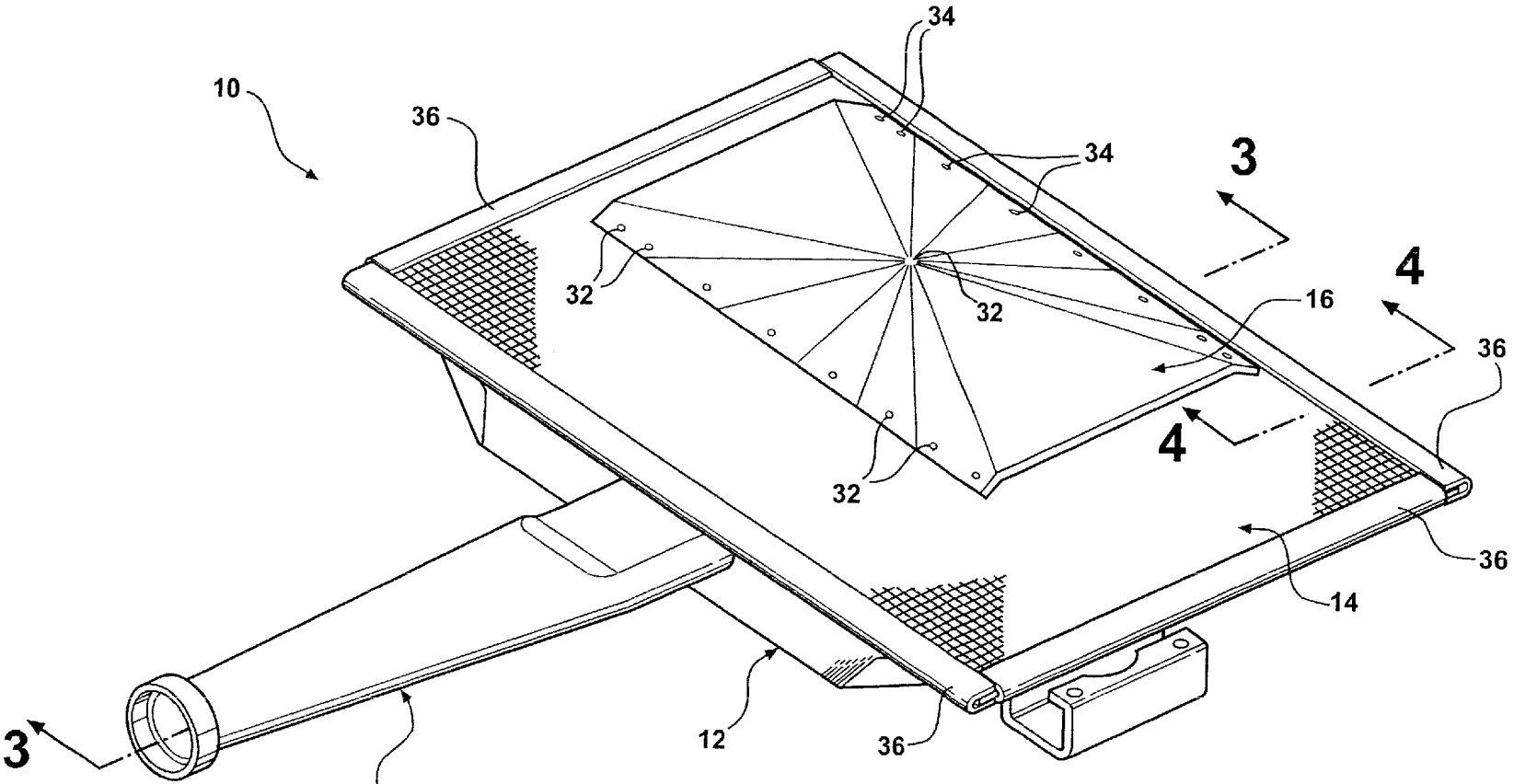
FIG. 1 is a perspective assembly view of a infra-red burner according to the present invention.

FIGS. 1–4 illustrate an infra-red burner unit 10 according to the resent invention of the type adapted for use as a top broiler in a gas oven (not shown). The burner unit 10 generally comprises a generally rectangular plenum 12, a dome-shaped wire mesh screen 14 attached to the plenum around the perimeter thereof, a blocking plate 16 secured to the approximate center of the screen, and a venturi 18 in communication with the plenum 12. As is well known in the gas burner art, a combustible gas/air mixture flows through the venturi 18 into the plenum 12 and escapes through the holes in the screen 14 at a controlled rate such that when the gas mixture is ignited on the exterior surface of the screen a flame is retained in close proximity to the screen over substantially the entire surface thereof.

When installed in an oven or broiler, the burner unit 10 is normally inverted from the position shown in FIG. 1 to serve as a top broiler. For simplicity of description, references to the top and bottom of the burner unit 10 will refer to it in the orientation shown in FIG. 1, with the screen 14 facing upwardly.

Figure 2:
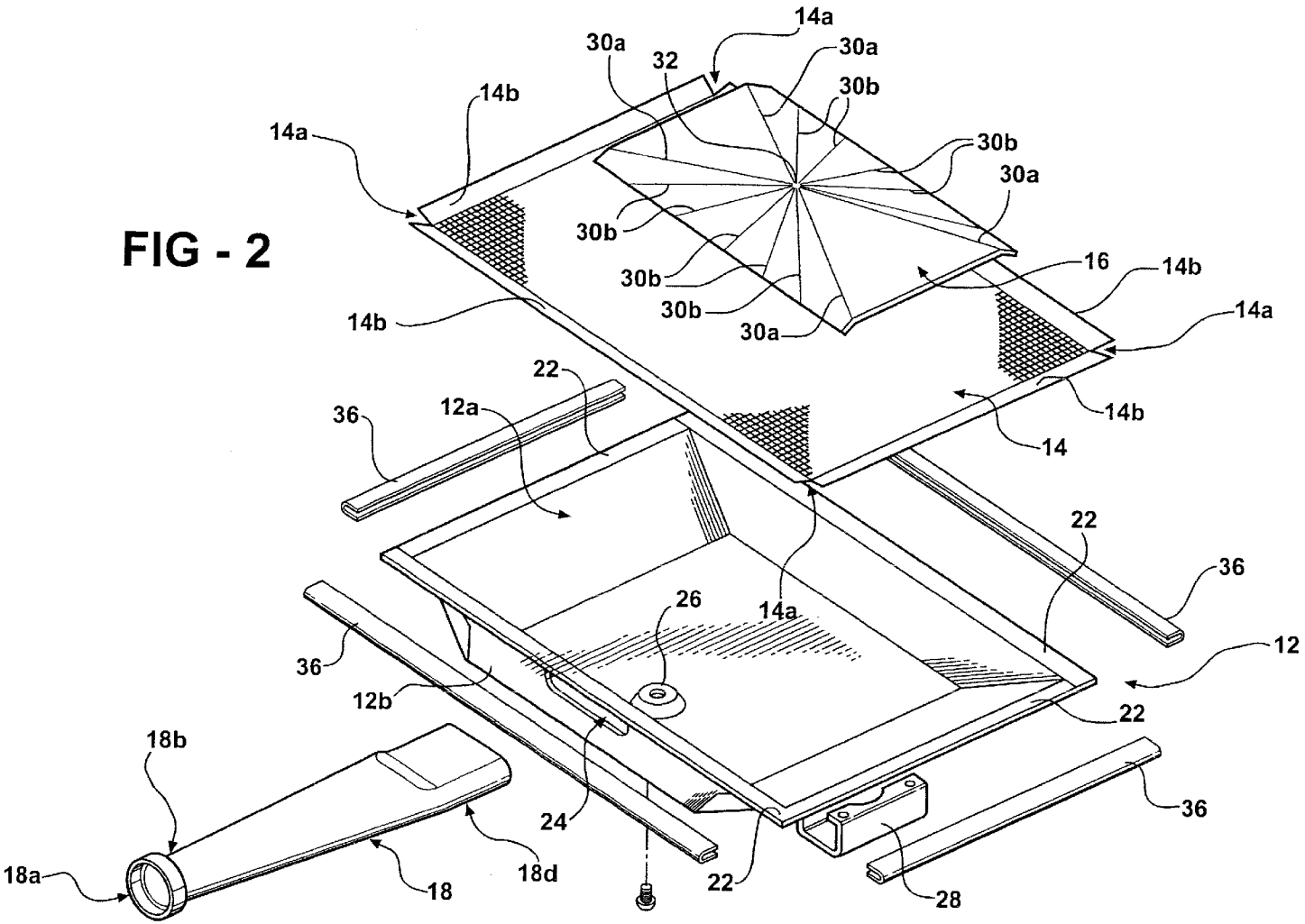
FIG. 2 is an exploded perspective view of the heater of FIG. 1.
Figure 3:
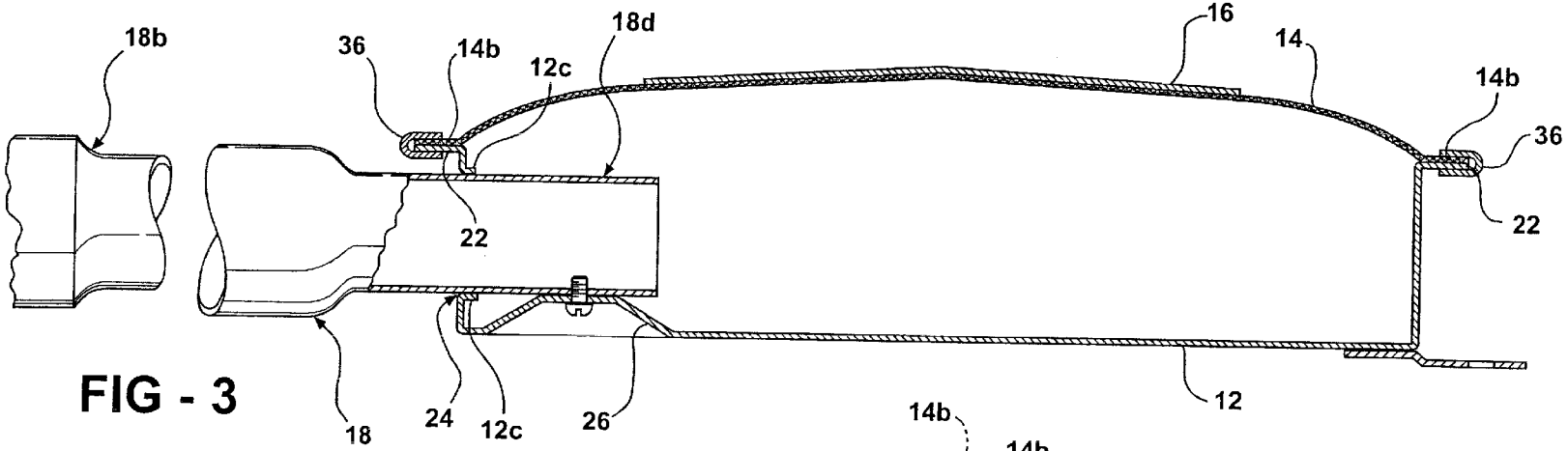
FIG. 3 is a cross-sectional view taken along line 3—3 of FIG. 1.

The plenum 12 is preferably formed from sheet stainless steel and is bent and spot welded to form a shallow rectangle having a burner opening 12*a* on its upper surface which is surrounded by flanges 22, as best seen in FIG. 2. A venturi opening 24 is located on one end wall 12*b* of the plenum 12 and a venturi mounting post 26 projects upwardly from the lower surface of the plenum directly in front of the venturi opening. A bracket 28 may be provided on the plenum for mounting an ignitor (not shown) as is well known in the gas burner art.

The venturi 18 is circular in cross section adjacent its inlet end 18*a*, narrowing to a throat 18*b* and then increasing gradually in diameter. The outlet end 18*d* of the venturi is flattened to form a generally oblong or elliptical cross section having an area equal to that of the circular portion of the venturi 18 at its largest diameter. It is important that the flattened outlet end 18*d* have at least as large an internal area as the circular section at the point of maximum diameter, as any reduction in internal cross-sectional area could interfere with the proper flow of the gas/air mixture through the venturi 18.

The outlet end 18*d* of the venturi is inserted into the venturi opening 24 such that the long or major axis of the elliptical cross section of the venturi outlet end is parallel to the burner opening 12*a*. Opening 24 is preferably swaged to form a flange 12*c* on the inside of the plenum (see FIG. 3) providing a tight interference fit around the outside of the venturi 18. The flat lower surface of the venturi outlet end 18*d* lays atop the upper end of the mounting post 26 and is welded, riveted, or otherwise secured in place to positively position the end of the venturi 18 with respect to the plenum 12.

Flattening the venturi outlet end 18*d* allows the vertical dimension of the hole 24 which receives the venturi to be smaller than would be necessary if the circular in cross section continued forward to the outlet end where it connects with the plenum 12. This in turn results in a reduction in the overall depth of the plenum 12. For example, a venturi having a maximum internal diameter of 1.437 in. gives a cross sectional area of 1.622 in. 2 When the end of the venturi is flattened, an equivalent cross sectional area is achieved by an ellipse having a minor axis of 0.974 in. and a major axis of 1.711 in., reducing the depth of the plenum by 0.463 in. A shallower burner unit 10 is desirable in order to occupy less vertical space within an oven, and hence provide more room for the food being cooked.

The burner screen 14 is formed from a metal wire mesh able to withstand high temperatures for extended periods of time. One example of an alloy used for such screens is Inconel. As best seen in FIG. 2, the screen 14 is generally rectangular and square notches 14*a* are formed at all four corners. The edges of the screen 14 between the notches 14*a* are bent upwardly to form tabs 14*b* projecting at an angle of approximately 30° from the plane of the screen. The screen 14 is preferably formed from a double thickness of mesh material.

The blocking plate 16 is generally rectangular and is preferably formed of stainless steel or a similar high-temperature metal. The plate 16 is stamped or otherwise formed to have a plurality of shallow, raised creases 30*a*,30*b* disposed in a star pattern radiating from the approximate center of the plate. In the preferred embodiment disclosed, two creases 30*a* extend to each of the short ends of the plate 16 and five creases 30*b* extend to each of the long ends of the plate. The plate 16 is bent slightly about creases 30*a*, giving the plate 16 a slightly concave-down shape to match the desired domed contour of the screen 14. The remainder of the creases 30*b* are slightly raised ridges, but the plate 16 is not bent about them to any substantial degree.

The screen 14 is placed in contact with the lower, concave surface of the plate 16 and the two components are spot welded together at the approximate center of the plate 32 and at a plurality of points 34 around the perimeter thereof, thereby causing the screen 14 to conform to the concave-down shape of the plate.

Figure 4:
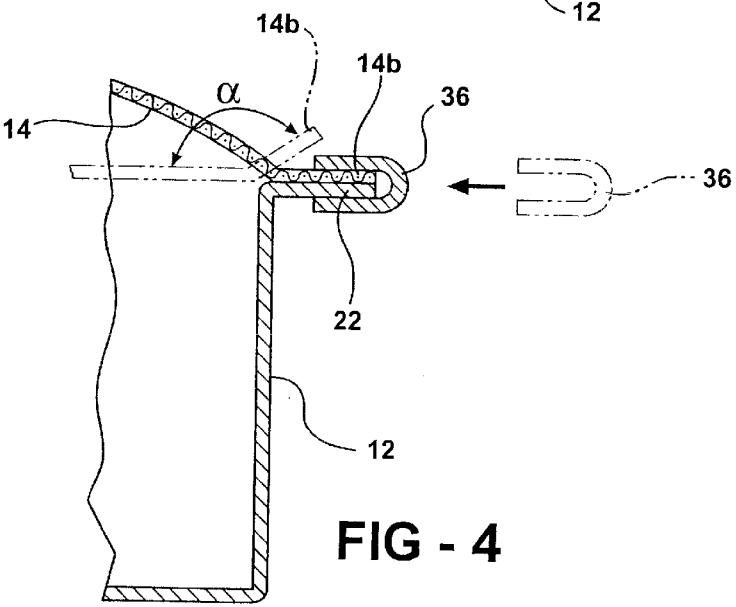
FIG. 4 is a cross-sectional view taken along 4—4 of FIG. 1.

After the plate 16 is secured to the screen 14, the assembly is joined to the plenum 12 by positioning the screen over the burner opening 12*a* so that the tabs 14*b* of the screen lie on top of the corresponding perimeter flanges 22 of the plenum 12. Clamp bars 36 are then placed over around the flanges 22 and tabs 14*a* along each of the four edges of the plenum (see FIG. 4) and crimped inwardly and spot welded at several points to securely join the screen 14 to the plenum 12 around the entire perimeter. The planar dimensions of the screen 14 are somewhat greater than the size of the burner opening 12*a* so that the screen is forced to bulge upwardly, away from the plenum 12 when the screen is secured to the plenum. The angle a between the tabs 14*b* and the central portion of the screen 14 also contribute to the bulging or domed shape of the screen 14. This effect is illustrated in FIG. 4, where phantom lines show the screen 14 prior to the tabs 14*b* being clamped down against the plenum flanges 22, and the sold lines show the screen in its domed condition after the tabs 14*b* have been pressed flat against the flanges.

The domed shape of the screen 14 allows it to increase in height in a uniform, controlled manner when it undergoes thermal expansion, without any rippling, waviness or other undesirable deformation of the screen. The configuration of the blocking plate 30 also contributes to controlled thermal expansion, the creases 30*a*,30*b* growing in height so that the horizontal dimensions of the plate remain relatively constant. The blocking plate 16 creates a non-radiating zone at the center of the burner, thus providing a more evenly distributed heat over the entire surface of a load being cooked. The flattened or elliptical cross section of the venturi 18 where it attaches to the plenum 12 permits a reduction in the overall depth of the burner unit 10 so that it takes up less vertical space when installed in an oven.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A gas-fired infra-red burner comprising: a plenum structure having a bottom and shallow sidewalls, the sidewalls having a predetermined height and forming a chamber for receiving a gas/air mixture and having a peripheral flange defining a generally planar burner opening, a venturi opening having a predetermined height and width, the width of the venturi opening being greater than the height of the sidewalls;

a wire screen secured to the peripheral flange and bulging out of the plane of the burner opening away from the chamber;

an inlet venturi having a first end and a second end, the second end having a flattened cross section for attachment to one of said sidewalls of the chamber; and a metal plate secured to the screen to block the flow of gas through the area of the screen covered by the plate, the plate having a plurality of edges and a center, the plate being generally rectangular and having a plurality of creases extending from the edges toward the center.

2. The infra-red burner according to claim 1 wherein the plate is secured to the screen at the approximate center of the screen.

3. The infra-red burner according to claim 1 wherein the plate has a plurality of creases formed therein and is bent about at least one of the creases such that the plate has a concave surface contacting the screen.

4. The infra-red burner according to claim 1 wherein the creases are disposed in a star pattern radiating from the approximate center of the plate.

5. The infra-red burner according to claim 1 wherein the plate is mechanically attached to the screen at a plurality of points.

6. The infra-red burner according to claim 1 wherein the perimeter of the plenum has at least two parallel, opposite edges and the screen has at least two parallel, opposite edges secured to the respective edges of the plenum, and the bulge of the screen is achieved at least in part by bending portions of the screen adjacent the opposite edges in the direction of the bulge prior to securing the portions to the edges of the plenum.

7. the infra-red burner according to claim 1 further comprising a venturi attached to the plenum for supplying the gas/air mixture thereto, the venturi having a first section adjacent its upstream end of a cross section and an adjoining second section of said flattened cross section having an internal area equal to a maximum internal area of the first section of the venturi, the second section connected with the plenum such that a major axis of said flattened cross section is parallel to the burner opening.

8. A gas-fired infra-red burner comprising:

a plenum structure having a bottom and shallow sidewalls forming a chamber for receiving a gas/air mixture and having a peripheral flange defining a generally planar burner opening;

a wire screen secured to the peripheral flange, covering the burner opening and bulging away from the chamber;

an inlet venturi attached to one of said sidewalls of the chamber and having a flattened profile; and a metal plate having a plurality of edges and a center, the plate being generally in the shape of a parallelogram, the plate secured to the approximate center of the screen to block the flow of gas through the area of the screen covered by the plate, the plate having a plurality of creases in a star pattern radiating from the approximate center of the plate toward the edges, the plate bent about at least one of the creases such that the plate has a concave surface contacting the screen.

9. The infra-red burner according to claim 8 wherein the perimeter of the plenum has at least two parallel, opposite edges and the screen has at least two parallel, opposite edges secured to the respective edges of the plenum, and the bulge of the screen is achieved at least in part by bending portions of the screen adjacent the opposite edges in the direction of the bulge to form tabs and securing the tabs to the respective edges of the plenum.

10. The infra-red burner according to claim 8 wherein the plate is mechanically attached to the screen at a plurality of points.

11. A gas-fired infra-red burner comprising:

a plenum structure having a bottom and shallow sidewalls forming a generally rectangular chamber with a generally planar open top and having a peripheral flange surrounding the open top;

a wire screen attached to the flange conforming to and covering the open top of the chamber, the screen being non-planar and protruding away from the chamber;

an inlet venturi attached to one of said sidewalls of the chamber and having a flattened cross-section; and a generally rectangular metal plate having a plurality of edges and a center, the plate having a plurality of creases extending from the edges toward the center of the plate, the plate secured to the screen and covering less than the total area thereof.

* * * * *